US009368893B2

(12) United States Patent
Koyama et al.

(10) Patent No.: US 9,368,893 B2
(45) Date of Patent: Jun. 14, 2016

(54) CONNECTION TERMINAL AND CONNECTOR USING SAME

(71) Applicant: OMRON Corporation, Kyoto-shi, Kyoto (JP)

(72) Inventors: Jiro Koyama, Shanghai (CN); Hirotada Teranishi, Osaka (JP); Takahiro Sakai, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/384,346

(22) PCT Filed: Mar. 14, 2013

(86) PCT No.: PCT/JP2013/057254
§ 371 (c)(1),
(2) Date: Sep. 10, 2014

(87) PCT Pub. No.: WO2013/137406
PCT Pub. Date: Sep. 19, 2013

(65) Prior Publication Data

US 2015/0031234 A1 Jan. 29, 2015

(30) Foreign Application Priority Data

Mar. 15, 2012 (JP) ..... 2012-059297

(51) Int. Cl.

| | |
|---|---|
| ***H01R 4/48*** | (2006.01) |
| ***H01R 13/05*** | (2006.01) |
| ***H01R 13/24*** | (2006.01) |
| *H01R 12/57* | (2011.01) |

(52) U.S. Cl.
CPC ..... *H01R 13/05* (2013.01); *H01R 13/2428* (2013.01); *H01R 13/2492* (2013.01); *H01R 12/57* (2013.01)

(58) Field of Classification Search
CPC ..... H01R 13/2442
USPC ..... 439/862, 500
See application file for complete search history.

(56) References Cited

U.S. PATENT DOCUMENTS

| | | | | |
|---|---|---|---|---|
| 4,494,807 | A * | 1/1985 | Cosmo | H05K 7/1069 439/68 |
| 6,290,524 | B1 * | 9/2001 | Simmel | H01R 13/6464 439/289 |
| 8,657,635 | B2 * | 2/2014 | Koyama | H01R 13/2464 439/500 |
| 2008/0268675 | A1 | 10/2008 | Suzuki et al. | |

(Continued)

FOREIGN PATENT DOCUMENTS

| | | | |
|---|---|---|---|
| JP | 2001-237015 | A | 8/2001 |
| JP | 2008-276987 | A | 11/2008 |

(Continued)

OTHER PUBLICATIONS

International Search Report for corresponding International Application No. PCT/JP2013/057254, mailed May 14, 2013 (4 pages).

*Primary Examiner* — Neil Abrams
(74) *Attorney, Agent, or Firm* — Osha Liang LLP

(57) ABSTRACT

A connection terminal has a movable contact which projects outside from a contact hole of a housing such that the movable contact can be pressed, and at least two curved portions connected to each other through a connecting portion. Each of the curved portions is pushed and widened by a load applied to the movable contact.

14 Claims, 8 Drawing Sheets

(56) References Cited

U.S. PATENT DOCUMENTS

| | | | | |
|---|---|---|---|---|
| 2012/0108111 | A1 | 5/2012 | Koyama et al. | |
| 2012/0171905 | A1 | 7/2012 | Koyama et al. | |
| 2015/0031234 | A1* | 1/2015 | Koyama | H01R 13/2428 439/374 |

FOREIGN PATENT DOCUMENTS

| | | | |
|---|---|---|---|
| JP | 2009-128218 | A | 6/2009 |
| JP | 4811530 | B1 | 11/2011 |
| JP | 4883215 | A | 2/2012 |

* cited by examiner

CONNECTION TERMINAL AND CONNECTOR USING SAME

TECHNICAL FIELD

The present invention relates to a connection terminal, e.g., not only to a connection terminal which is incorporated in a housing to form a connector, but also to a connection terminal which can directly be mounted on a substrate and can be used.

BACKGROUND ART

As a conventional connection terminal, there is an IC socket contact on which a connection terminal contact is integrally formed through a spring side having a backbone portion connected to a support side, characterized in that the spring side is formed into a laterally oriented substantially U-shape which is composed of an upper piece arm extending from a connecting portion to the connection terminal contact and a lower piece arm extending toward the backbone portion, the upper piece arm is composed of a first spring portion and a second spring portion which are separated away from each other and which extend in parallel to each other, and a third spring portion and a fourth spring portion which are separated away from each other and which extend in parallel to each other, and the spring side downwardly inclines from the connecting portion toward the backbone portion (see Patent Document 1).

PRIOR ART DOCUMENT

Patent Document

Patent Document 1: Japanese Patent Publication No. 2001-237015

SUMMARY OF THE INVENTION

Problems to be Solved by the Invention

However, the above-described IC socket contact has a problem that if an external force is applied, stress is prone to concentrate on a backbone portion 5, and if an attempt is made to increase a displacement amount, plastic deformation is prone to generate.

It is an object of the present invention to provide a connection terminal which moderates stress concentration and has excellent durability in which a displacement amount can be increased and plastic deformation is less prone to generate.

Means for Solving Problem

To solve the problem, a connection terminal of the present invention comprises a movable contact which projects outside from a contact hole of a housing such that the movable contact can be pressed, and a curved portion which is pushed and widened by a load applied to the movable contact.

Effect of the Invention

According to the present invention, it is possible to provide a connection terminal having an excellent durability, in which even if an external force is applied to a movable contact and the connection terminal elastically deforms, it is possible to prevent stress from being concentrated on a specific location by pushing and widening curved portions, and it is possible to prevent the connection terminal from being plastically deformed.

The connection terminal may further include at least two curved portions, and the curved portions may be connected to each other through a connecting portion.

By connecting the two curved portions to each other, it is possible to obtain a connection terminal having small size or depth.

At least two curved portions may be connected to each other through the connecting portion to form substantially a shape of letter "3".

By connecting the curved portions to each other into a shape of letter "3", it is possible to obtain a connection terminal having smaller size or depth.

The shape of letter "3" is such a shape that adjacent two of curved portions are connected to each other such that openings of the curved portions are oriented to the same direction and more particularly, the shape of letter "3" is such a shape that openings of the curved portions are oriented to the same direction with respect to a line segment which connects both ends of the adjacent two curved portions.

A spring constant of the connecting portion may be greater than that of the carved portion.

Since the spring constant of the connecting portion is greater than that of the curved portions, the connecting portion serves as a rigid body. Therefore, the plurality of curved portions elastically deform in a direction in which the curved portions are pushed and widened. Hence, it is possible to obtain a small size connection terminal in which a displacement amount is large, stress concentration is moderated, and plastic deformation is less prone to generate.

Curvature radii of at least the two curved portions may be different from each other.

Since the curvature radii are different from each other, when an external force is applied, it is possible to change deformation amounts generated in various portions of the curved portions, and the freedom of the design choice is enhanced.

A curvature radius of one of the curved portions placed closest to the movable contact may be greater than a curvature radius of the other curved portion.

According to this, when an external force is applied, a deformation amount of one of the curved portions closer to the movable contact is made large and a deformation amount of the other curved portion is made small. Therefore, even when the entire connection terminal receives a large load, it is possible to obtain a connection terminal having small influence of stress concentration.

Curvature radii of the curved portions may be sequentially reduced from the movable contact.

According to this, when an external force is applied, the deformation amounts of the curved portions sequentially become smaller from the movable contact side. When the connection terminal receives a large load, it is possible to obtain a connection terminal having small influence of stress concentration.

A straight line connecting between a free end and a wobbling point may be inclined toward a load.

According to this, when an external force is applied, it is possible to largely secure a pushing amount of the movable contact.

The curved portion may include a slit formed by a plurality of extending portions.

According to this, it is possible to moderate stress concentration by the slit formed between the extending portions.

The movable contact may be connected to a free end of the curved portion.

According to this, it is possible to enhance contract reliability and to reliably transmit, to the curved portion, an external force applied to the movable contact. Especially, it is possible to enhance impact resistance when a large load is applied from outside.

A guide portion is provided which extends from a tip end of the movable contact and curves toward the curved portion.

According to this, when an external force is applied, the movable contact is turned and guided by the guide portion and can be reliably moved into a contact hole.

When the movable contact is pressed, the guide portion moves toward the curved portion.

According to this, the movable contact can reliably be guided into the contact hole.

The connection terminal further comprises a base portion of the curved portion which is located farthest from the movable contact; and a press-fitting and fixing portion formed at the base portion for the connection with the housing.

According to this, the connection terminal can reliably be fixed to the housing through the press-fitting and fixing portion.

As a new embodiment of the present invention, the guide portion may have such a shape that when the movable contact is pressed, the guide portion abuts against a base portion of the curved portion. For example, when the connection terminal is formed from one curved portion, the guide portion may be formed into a shape which abuts against the base portion of the curved portion. When the connection terminal is formed from a plurality of curved portions, the guide portion may be formed into a shape which abuts against a base portion of any one of the curved portions or abuts against the connecting portion which is located at the base portion.

According to this embodiment, the guide portion abuts against the base portion (connecting portion) of the curved portion, and it is possible to prevent stress from being concentrated on a specific location, and to prevent the connection terminal from being plastically deformed. Therefore, a connection terminal having excellent durability can be obtained.

Electric resistance from the guide portion to the base portion becomes small by the abutment between the guide portion and the base portion of the curved portion and thus, it is possible to increase a current value which can be conducted to the connection terminal.

In a connector of the present invention, a press-fitting and fixing portion of the connection terminal is press fitted into and fixed to a press-fitting hole of the housing, and the movable contact projects from a contact hole provided in the housing such that the movable contact can move into and out from the contact hole.

According to this, it is possible to obtain a small connector which has a small depth and excellent durability and which is capable of preventing stress concentration.

MODE FOR CARRYING OUT THE INVENTION

Embodiments of connection terminals according to the present invention will be described in accordance with accompanying drawings of FIGS. 1 to 5.

First Embodiment

A first embodiment shows a case where connection terminals 21 are press fitted into a resin-molded housing 10 with a predetermined pitch as shown in FIGS. 1 to 3.

Figure 1A:
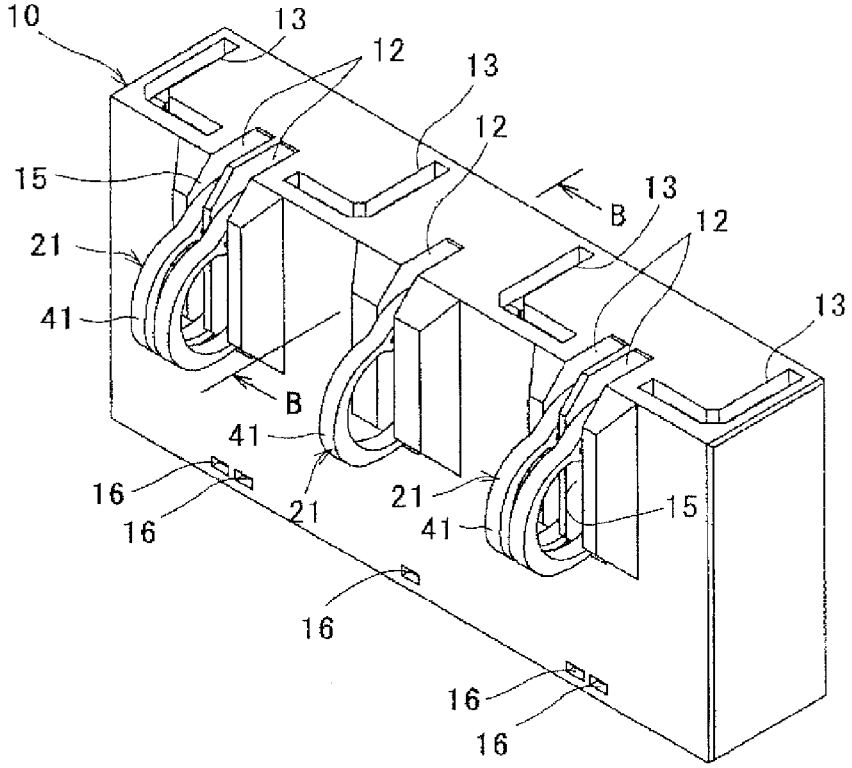
FIG. 1A is a perspective view showing a connector in which connection terminals according to a first embodiment of the present invention is incorporated.
Figure 1B:
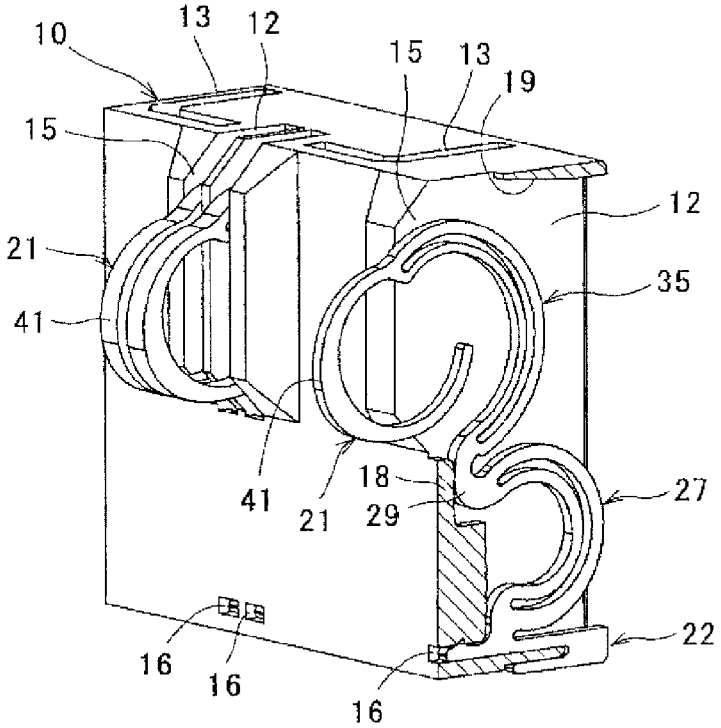
FIG. 1B is a sectional perspective view taken along line B-B in FIG. 1A.

As shown FIGS. 1A and 1B, the housing 10 is provided with accommodating spaces 12 into which connection terminals 21 can be press fitted from a back side of the housing 10, and through holes 13 having L-shaped cross sections. Fixing brackets (not shown) having L-shaped cross sections which stand on a substrate are inserted through the through holes 13. A front surface of the housing 10 is provided with contact holes 15 which are in communication with the accommodating spaces 12 and press-fitting holes 16 which are in communication with the accommodating spaces 12. Movable contacts 41, which will be described later, can move into and out from the contact holes 15. Position-restricting receiving portions 18 are formed on lower side inner surfaces of the contact holes 15.

Figure 2A:
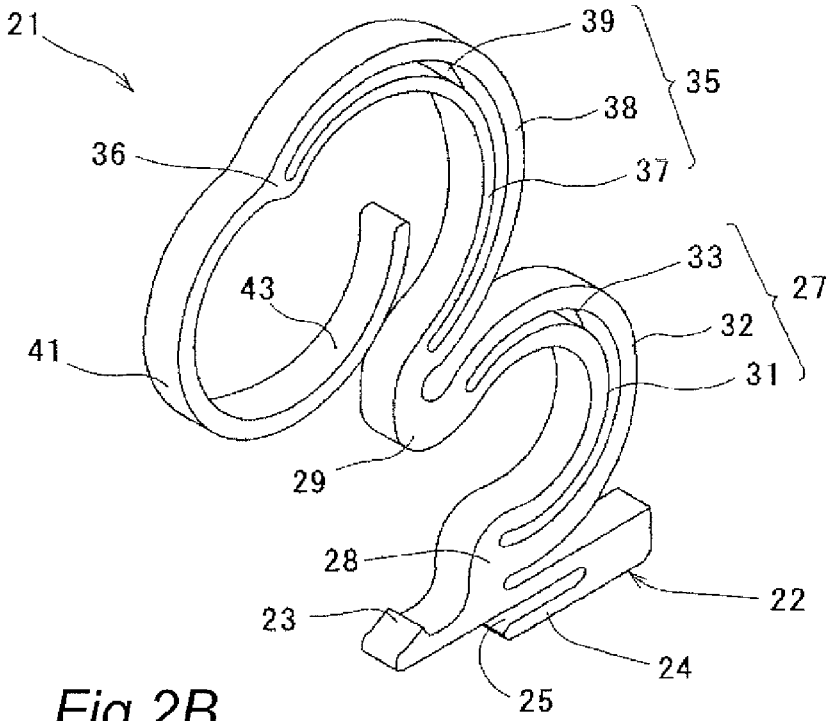
FIG. 2A is a perspective view of the connection terminal according to the first embodiment of the invention.
Figure 2B:
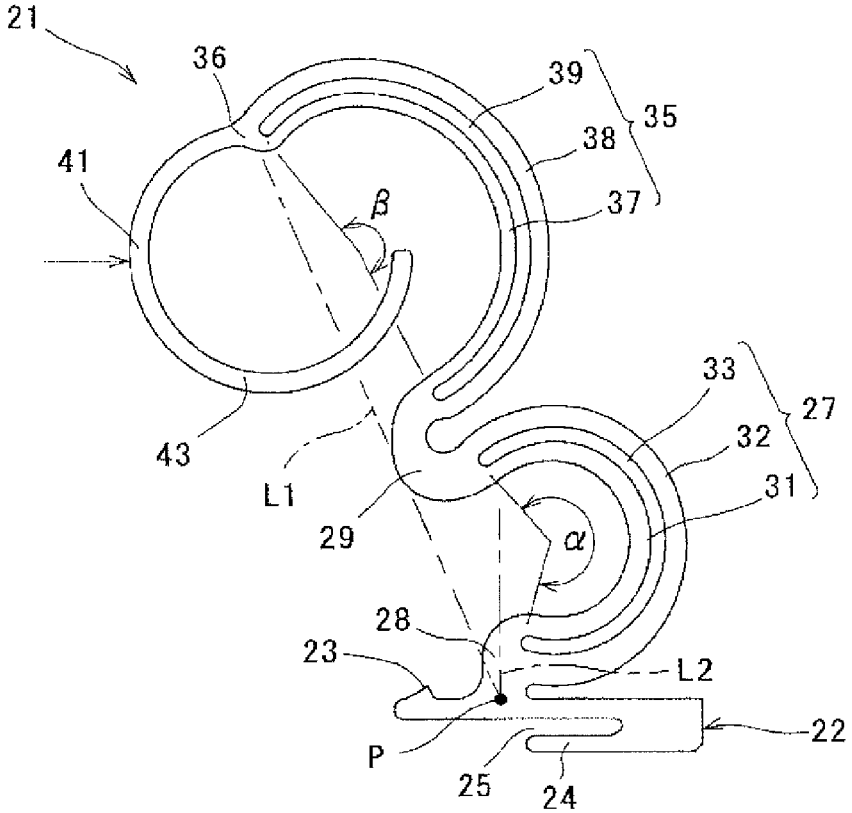
FIG. 2B is a side view of FIG. 2A.

As shown FIGS. 2A and 2B, each of the connection terminals 21 includes a press-fitting and fixing portion 22 which is fitted into and fixed to the housing 10, a first curved portion 27 and a second curved portion 35 which extend from the press-fitting and fixing portion 22, and the movable contact 41 provided on a free end of the second curved portion 35.

An engaging pawl 23 projects from an upper surface of one end of the press-fitting and fixing portions 22 and a lower surface of the other end is provided with a connection portion 24, thereby forming a press-fitting notch 25. Since the press-fitting and fixing portion 22 is provided at a base portion of the first curved portion 27 which is located farthest from the movable contact 41, the connection terminal 21 can reliably be fixed to the housing 10 through the press-fitting and fixing portion 22.

First curved portion 27 has a substantially arc shape. A support portion 28 is formed on one end of the first curved portion 27. The support portion 28 projects upward from the press-fitting and fixing portion 22 such that the support portion 28 intercrosses with the press-fitting and fixing portion 22. A substantially arc-shaped connecting portion 29 is formed on the other end of the first curved portion 27. A wobbling point P of the connection terminal 21 is provided on a boundary between the support portion 28 and the press-fitting and fixing portion 22 when the movable contact 41 is pressed.

It is preferable that the connecting portion 29 can be regarded as a rigid body with respect to the first curved portion 27. If the connecting portion 29 is the rigid body, when an external force is applied to the movable contact 41 (described later), the first curved portion 27 is pushed and the curvature is widened. Therefore, it is possible to prevent stress from being concentrated on a specific location, and to prevent the connection terminal 21 from being plastically deformed.

In order to make the connecting portion 29 a rigid body, it is necessary that a spring constant of the connecting portion 29 is greater than those of the first curved portion 27 and the second curved portion 35 (described later). Especially, to bring the connecting portion 29 closer to an ideal rigid body, it is preferable that the spring constant of the connecting portion 29 is greater than those of the first curved portion 27 and the second curved portion 35 by a one digit place or more, i.e., more than 10 times.

The first curved portion 27 includes a first inner extending portion 31 and a first outer extending portion 32 which are curved and are bifurcating from the support portion 28. A first slit 33 is formed between first inner extending portion 31 and first outer extending portion 32. The first inner extending portion 31 and first outer extending portion 32 are integrally famed together through the connecting portion 29, where the first slit 33 terminates. An angle $\alpha$ around a center of curvature measured between an end of the first curved portion 27 on the side of the support portion 28 and an end of the first curved portion 27 on the side of the connecting portion 29 is greater than 180°.

The second curved portion 35 has an arc shape having a curvature radius greater than that of the first curved portion 27. The connecting portion 29 is formed on one of ends of the second curved portion 35, and the movable contact 41 is formed the other end of the second curved portion 35 on the side of a free end 36. The second curved portion 35 includes a second inner extending portion 37 and a second outer extending portion 38 which are curved and are bifurcated from the connecting portion 29. A second slit 39 is formed between second inner extending portion 37 and second outer extending portion 38. The second inner extending portion 37 and the second outer extending portion 38 are integrally formed together through the free end 36, where the second slit 39 terminates.

An angle $\beta$ around a center of curvature measured between an end of the second curved portion 35 on the side of the connecting portion 29 and an end of the second curved portion 35 on the side of the free end 36 is greater than 180°. Since both the angle $\alpha$ around the center of curvature and the angle $\beta$ around the center of curvature are greater than 180°, when an external force is applied to the movable contact 41, the first curved portion 27 is pushed and the curvature is widened. Hence, it is possible to prevent stress from being concentrated on a specific location, and to prevent the connection terminal 21 from being plastically deformed.

A straight line L1 connecting between the free end 36 and the wobbling point P is inclined from a vertical line L2 in a direction towards a point where a load acts. Accordingly, when an external force is applied, it is possible to secure a large shifting distance of the movable contact 41.

Further, since the first curved portion 27 and the second curved portion 35 having openings oriented to the same direction are connected to each other to form substantially a shape of letter "3" through the connecting portion 29, it is possible to form a connection terminal having a small size in depth. Also, it is possible to scatter the stress by the first slit 33 and the second slit 39 provided in the first curved portion 27 and the second curved portion 35, respectively. Since the size of the first curved portion 27 and that of the second curved portion 35 can be made different, it is possible to change displacement amounts of the respective curvature when an external force is applied, and it becomes easy to design the connection terminal in accordance with intended use. The size or the length of the second curved portion 35 located on the upper side is greater than that of the first curved portion 27 located on the lower side. Hence, when an external force is applied, the deformation amount of the second curved portion 35 is greater than that of the first curved portion 27. Also, an external force can be propagated to the entire connection terminal 21. The freedom of the design choice is enhanced.

The movable contact 41 outwardly extends and curves from the free end 36 of the second curved portion 35. Since the movable contact 41 is connected to the free end 36 of the second curved portion 35, contact reliability can be enhanced, and an external force applied to the movable contact 41 can reliably be transmitted to the second curved portion 35. Especially when a large impact force is applied from outside, it is possible to scatter the impact force, and to enhance impact resistance. In a state where the connection terminal 21 is press fitted into and fixed to the housing 10, the movable contact 41 projects from the contact hole 15 such that the movable contact 41 can be pressed. Further, a downwardly curved guide portion 43 extends toward the second curved portion 35 from an end of the movable contact 41 opposite from the free end 36. Since the guide portion 43 extends from a tip end of the movable contact 41 toward the second curved portion 35 in this manner, when an external force is applied, the movable contact 41 is guided by the guide portion 43, and the movable contact 41 can reliably move in the contact hole 15 without being clogged in the contact hole 15 of the housing 10. Further, since the guide portion 43 is formed in a curvature, when an external force is applied, the guide portion 43 can turn about a center of its curvature and can move in the contact hole 15.

It is not necessary that the movable contact 41 is made separately from the second curved portion 35 or the guide portion 43, and the movable contact 41 may share its function with the second curved portion 35 or the guide portion 43. In this case, a region which projects from the contact hole 15, provided that no external force is applied, is called the movable contact 41.

Figure 3A:
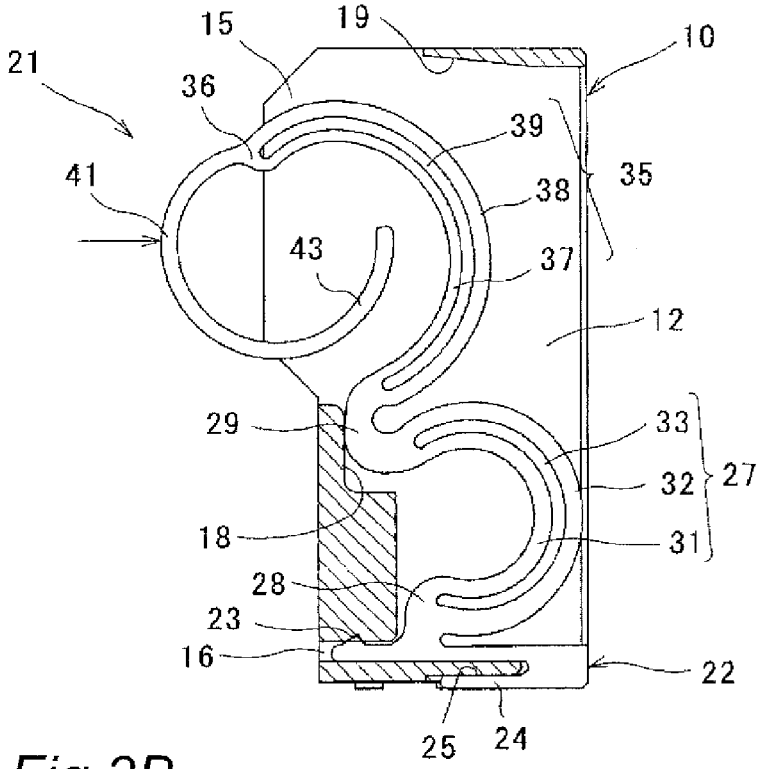
FIG. 3A is a sectional view of the connection terminal according to the first embodiment shown in FIG. 1 before it is operated.

To form the connector through the steps of incorporating each of the connection terminals 21 into the housing 10, the connection terminal 21 is first inserted into the accommodating space 12 from its back side, and then the press-fitting and fixing portion 22 is press fitted into the press-fitting hole 16 as shown in FIG. 3A. The engaging pawl 23 is engaged with an inner surface of the press-fitting hole 16, and the connection portion 24 is engaged with an edge of the housing 10, thereby preventing the connection portion 24 from being pulled out. An outer surface of the connecting portion 29 of the connection terminal 21 abuts against the position-restricting receiving portion 18 of the housing 10 and a position thereof is restricted. Since the connector is configured using the connection terminal 21 of the present invention as described above, it is possible to prevent the stress from being concentrated in a narrow spot, and thus obtaining a connector having an excellent durability.

Figure 3B:
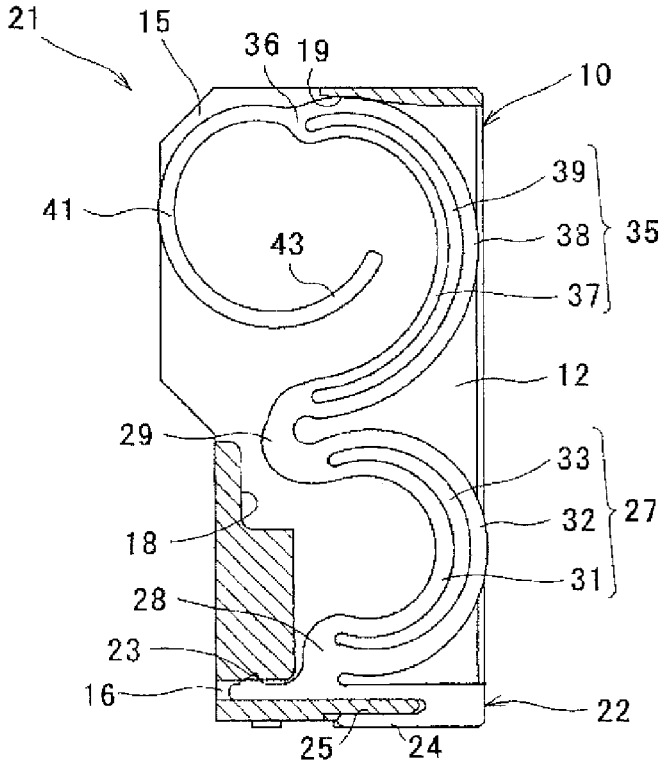
FIG. 3B is a sectional view of FIG. 3A after the connection terminal is operated.

If the movable contact 41 of the connector mounted on a printed substrate (not shown) is pushed in, the second curved portion 35 is pushed and widened and in this state, the second curved portion 35 moves toward the back side of the housing 10 and the second outer extending portion 38 abuts against a ceiling surface 19 as shown in FIG. 3B. At the same time, the connecting portion 29 moves away from the position-restricting receiving portion 18, and the first curved portion 27 is also pushed and widened like the second curved portion 35. Since the spring constant of the connecting portion 29 is greater than those of the first curved portion 27 and the second curved portion 35 by one digit place or more, the connecting portion 29 hardly deforms.

If an external force is applied to the movable contact 41 and the connection terminal 21 elastically deforms as described above, both the first curved portion 27 and the second curved portion 35 are pushed and widened. Hence, it is possible to prevent stress from concentrating on a specific location. According to this, it is possible to prevent the connection terminal 21 from plastically deforming, and to obtain the connection terminal 21 having excellent durability. If the movable contact 41 is pushed in, the guide portion 43 moves such that it curls into the second curved portion 35. Hence, the movable contact 41 is guided by the guide portion 43 and can reliably move in the contact hole 15 without being hindered by the contact hole 15 of the housing 10.

The present invention is not limited to the above-described embodiment, and the invention can variously be modified.

Second Embodiment

Figure 4:
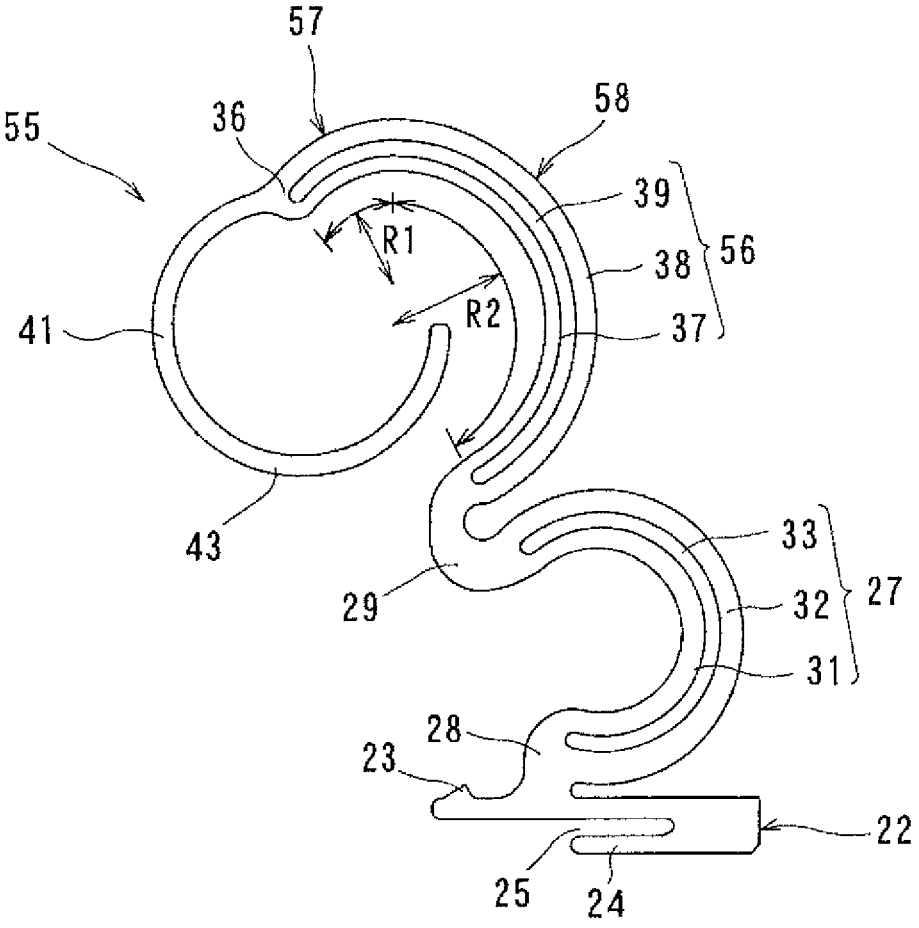
FIG. 4 is a side view of a connection terminal according to a second embodiment of the invention.

As shown in FIG. 4, a connection terminal 55 of a second embodiment has a second curved portion 56 including two arc sections having different curvature radii. For example, a curvature radius R1 of an upper half section 57 of a second curved portion 56 is smaller than a curvature radius R2 of a lower half section 58.

Since the second curved portion 56 has the two different curvature radii, when an external force is applied, it is possible to change deformation amounts generated in different sections of the second curved portion 56, and the freedom in design choice is enhanced. Since the curvature radius of the upper half section 57 is smaller than that of the lower half section 58, when an external force is applied, a deformation amount of the second curved portion 56 on the side of the movable contact 41 is made small and a deformation amount of the second curved portion 56 on the side of the connecting portion 29 is made great, and even when the entire connection terminal 21 receives a large load, it is possible to obtain a connection terminal 21 having small influence of stress concentration.

Third Embodiment

Figure 5:
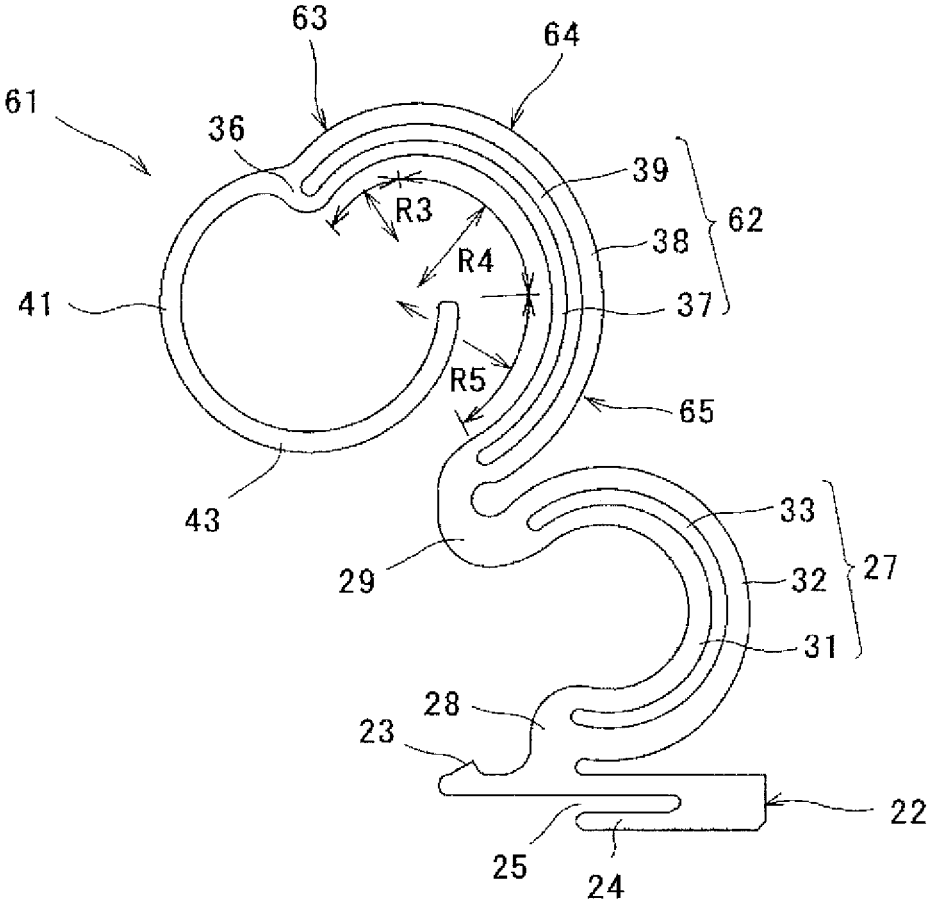
FIG. 5 is a side view of a connection terminal according to a third embodiment of the invention.

As shown in FIG. 5 a connection terminal 61 according to a third embodiment has a second curved portion 62 including three arc sections having different curvature radii. For example, a curvature radius R3 of an upper half section 63 configuring the second curved portion 62 is smaller than a curvature radius R4 of an intermediate section 64, and the curvature radius R4 of the intermediate section 64 is smaller than a curvature radius R5 of a lower half section 65.

The curvature radius of the second curved portion 62 is sequentially increased from the movable contact 41 toward the connecting portion 29. Hence, when an external force is applied, a deformation amount of the second curved portion 62 is sequentially increased from the movable contact 41, and it is possible to obtain the connection terminal 61 having small influence of stress concentration even when the entire connection terminal 61 receives a large load.

Fourth Embodiment

Figure 6A:
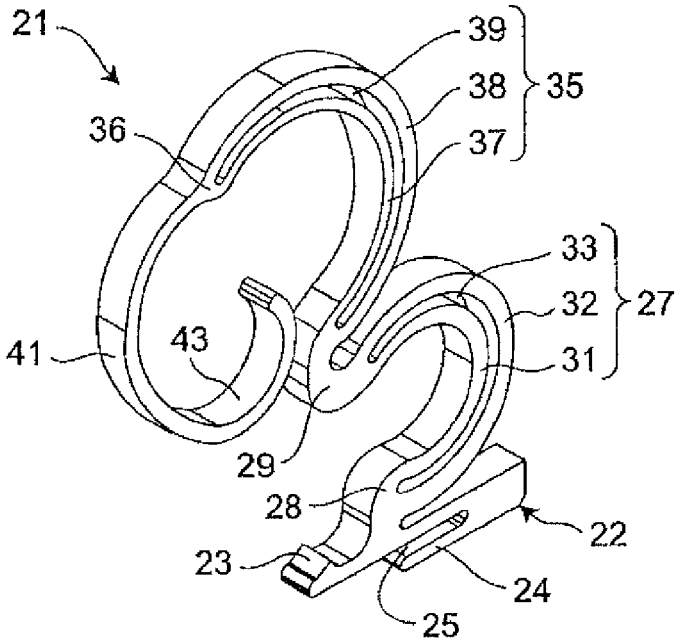
FIG. 6A is a perspective view of a connection terminal according to a fourth embodiment of the invention.
Figure 6B:
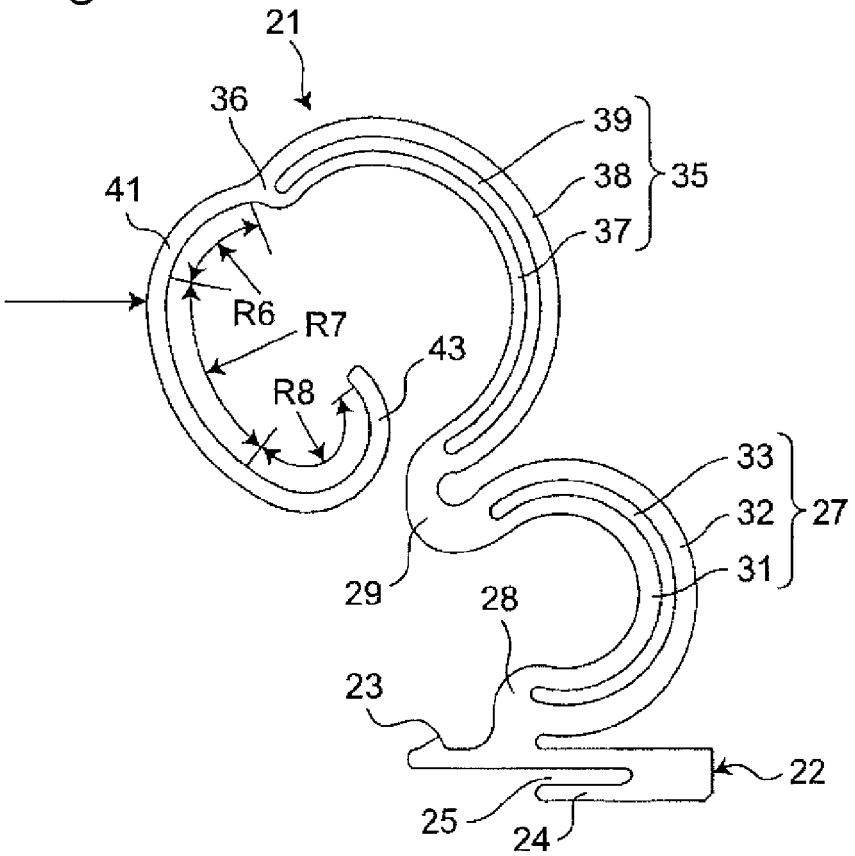
FIG. 6B is a side view of FIG. 6A.
Figure 7A:
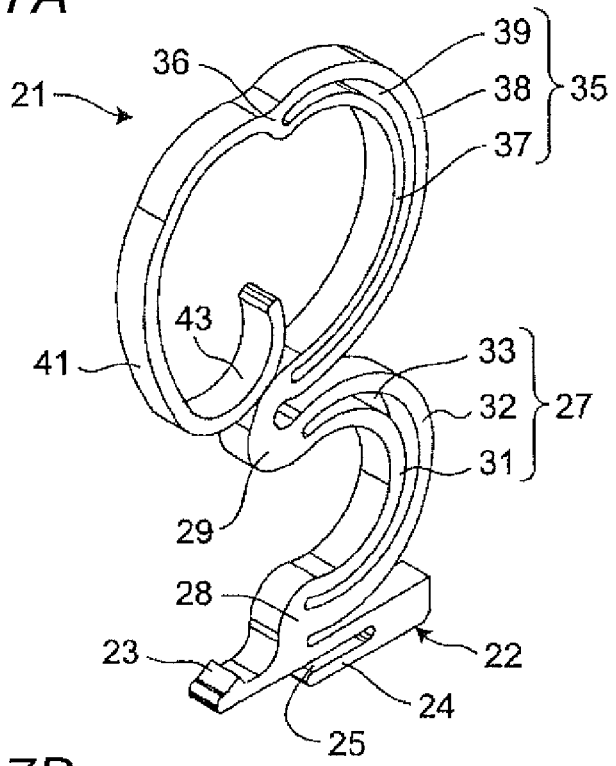
FIG. 7A is a perspective view of the connection terminal according to the fourth embodiment shown in FIG. 6 after it is operated.
Figure 7B:
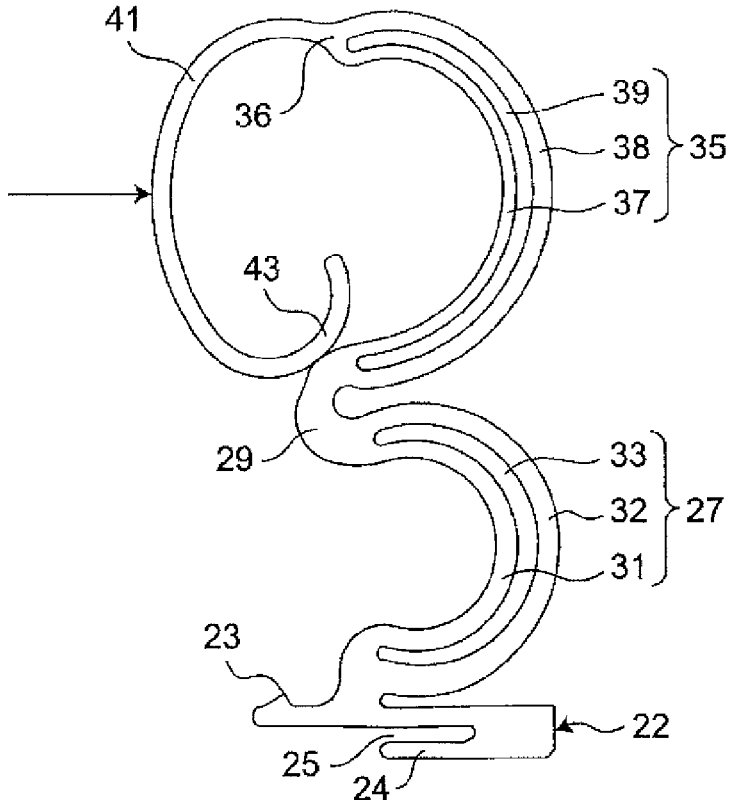
FIG. 7B is a side view of FIG. 7A.

A connection terminal 21 according to a fourth embodiment shown in FIGS. 6 to 8 is substantially the same as those of the previous embodiments, but the connection terminal 21 of the fourth embodiment is different from those of the previous embodiments in that a movable contact 41 is includes two arc sections having different curvature radii R6 and R7. A guide portion 43 composed of an arc section having a different curvature radius R8 from the rest extends from a free end of the movable contact 41, and the guide portion 43 can abut against a connecting portion 29. Since other configurations are substantially equal to those of the previous embodiments, the same reference signs are allocated to the same members, and description thereof will be omitted.

Figure 8A:
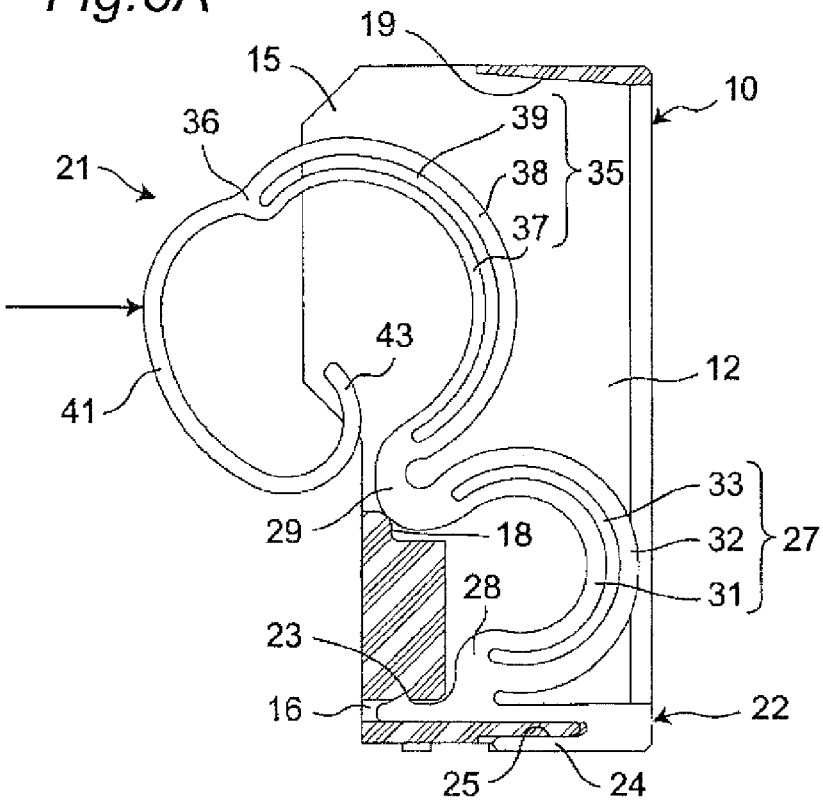
FIG. 8A is a sectional view of a connector before it is operated in which the connection terminal according to the fourth embodiment shown in FIG. 6 is incorporated.

Next, to forma connector through the steps of incorporating each of the connection terminals 21 into a housing 10, the connection terminal 21 is inserted into an accommodating space 12 from a back side thereof, and a press-fitting and fixing portion 22 is press-fitted into a press-fitting hole 16 as shown in FIG. 8A. An engaging pawl 23 is engaged with an inner surface of the press-fitting hole 16 and a connection portion 24 is engaged with an edge of the housing 10, thereby preventing the connection portion 24 from being pulled out. An outer surface of a connecting portion 29 of the connection terminal 21 abuts against a position-restricting receiving portion 18 of the housing 10 and a position thereof is restricted. Since the connector is configured using the connection terminal 21 of the present invention as described above, it is possible to prevent the stress concentration, and to obtain a connector having excellent durability.

Figure 8B:
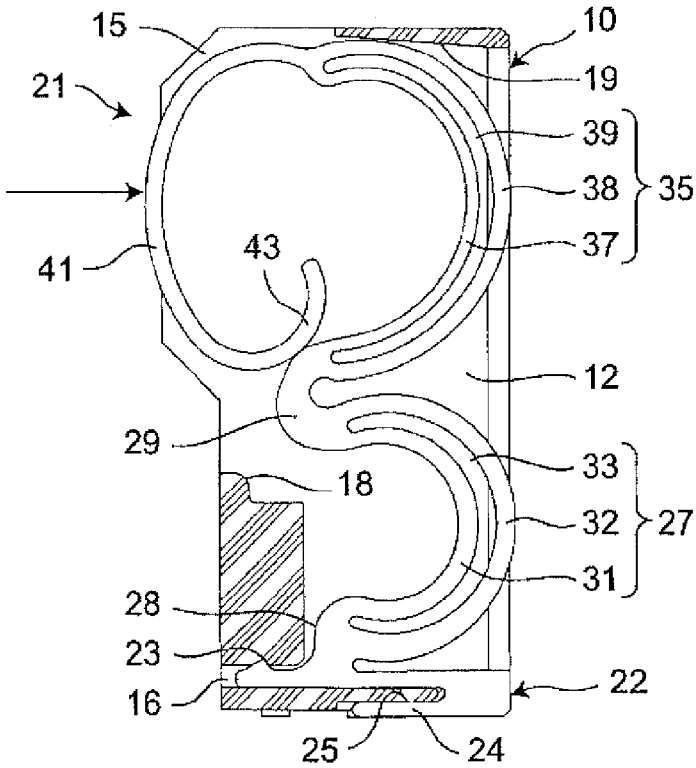
FIG. 8B is a sectional view of FIG. 8A after the connector is operated.

If the movable contact 41 of the connector mounted on a printed substrate (not shown) is pushed in, the movable contact 41 elastically deforms inward as shown in FIG. 8B, a second curved portion 35 is pushed and widened and in this state, the second curved portion 35 moves toward a back side of the housing 10 and the connecting portion 29 moves away from the position-restricting receiving portion 18. At this time, a first curved portion 27 is also pushed and widened like the second curved portion 35. Next, the guide portion 43 abuts against the connecting portion 29 and a second outer extending portion 38 abuts against a ceiling surface 19. Since a spring constant of the connecting portion 29 is greater than those of the first curved portion 27, the second curved portion 35 and the movable contact 41 by one digit place or more, the connecting portion 29 does not deform almost at all.

As described above, if an external force is applied to the movable contact 41 and the connection terminal 21 elastically deforms, both the first curved portion 27 and the second curved portion 35 are pushed and widened. Furthermore, the guide portion 43 abuts against the connecting portion 29. Hence, it is possible to prevent stress from being concentrated on a specific location. According to this, it is possible to prevent the connection terminal 21 from being plastically deformed, and to obtain the connection terminal 21 having excellent durability.

INDUSTRIAL APPLICABILITY

The shapes of the connection terminals according to the present invention are not limited to those described above, and the connection terminals are not especially limited to those described above. Various connection terminals are included as long as they include the curved portions which can be pushed and widened.

It is possible to employ a curved portion including a plurality of arc sections having different curvature radii.

When the connection terminal is composed of one curved portion, the guide portion may abut against the base portion of the curved portion. When the connection terminal is composed of a plurality of curved portions, the guide portion may abut against a connecting portion formed between the curved portions.

DESCRIPTION OF REFERENCE CHARACTERS

10 housing
15 contact hole
16 press-fitting hole
21 connection terminal
22 press-fitting and fixing portion
27 first curved portion
29 connecting portion
31 first inner extending portion
32 first outer extending portion
35 second curved portion
36 free end
37 second inner extending portion
38 second outer extending portion
41 movable contact
43 guide portion
55 connection terminal
56 second curved portion
61 connection terminal
62 second curved portion

The invention claimed is:

1. A connection terminal comprising:
a movable contact which projects outside from a contact hole of a housing such that the movable contact can be pressed; and
at least two curved portions connected to each other through a connecting portion,
wherein each of the curved portions is pushed and widened by a load applied to the movable contact, and
wherein a spring constant of the connecting portion is greater than that of the curved portions.

2. The connection terminal according to claim 1,
wherein at least two curved portions are connected to each other through the connecting portion to form substantially a shape of letter "3".

3. The connection terminal according to claim 1,
wherein curvature radii of at least the two curved portions are different from each other.

4. The connection terminal according to claim 3,
wherein a curvature radius of one of the curved portions placed closest to the movable contact is greater than a curvature radius of the other curved portion.

5. The connection terminal according to claim 3,
wherein curvature radii of the curved portions are sequentially reduced from the movable contact.

6. The connection terminal according to claim 1,
wherein a straight line connecting between a free end and a wobbling point is inclined toward a load.

7. The connection terminal according to claim 1,
the curved portion includes a slit formed by a plurality of extending portions.

8. The connection terminal according to claim 1,
the movable contact is connected to a free end of the curved portion.

9. The connection terminal according to claim 1, further comprising:
a guide portion which extends from a tip end of the movable contact and curves toward the curved portion.

10. The connection terminal according to claim 9,
wherein when the movable contact is pressed, the guide portion moves toward the curved portion.

11. The connection terminal according to claim 1,
wherein the curved portion includes a plurality of arc sections having different curvature radii.

12. The connection terminal according to claim 1, further comprising:
a base portion of the curved portion which is located farthest from the movable contact; and
a press-fitting and fixing portion formed at the base portion for the connection with the housing.

13. The connection terminal according to claim 9,
the guide portion has such a shape that when the movable contact is pressed, the guide portion abuts against a base portion of the curved portion.

14. A connector comprising:
the connection terminal according to claim 1,
wherein the press-fitting and fixing portion of the connection terminal is press fitted into and fixed to a press-fitting hole of the housing, and
wherein the movable contact projects from a contact hole provided in the housing such that the movable contact can move into and out from the contact hole.

* * * * *